US010801307B2

(12) United States Patent
Roussel et al.

(10) Patent No.: US 10,801,307 B2
(45) Date of Patent: Oct. 13, 2020

(54) ENGINEERED STRESS STATE WITH MULTI-WELL COMPLETIONS

(71) Applicant: ConocoPhillips Company, Houston, TX (US)

(72) Inventors: Nicolas P. Roussel, Houston, TX (US); Mike D. Lessard, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 174 days.

(21) Appl. No.: 15/823,801

(22) Filed: Nov. 28, 2017

(65) Prior Publication Data

US 2018/0149000 A1 May 31, 2018

Related U.S. Application Data

(60) Provisional application No. 62/427,262, filed on Nov. 29, 2016, provisional application No. 62/427,280, filed on Nov. 29, 2016.

(51) Int. Cl.

| | |
|---|---|
| ***E21B 41/00*** | (2006.01) |
| ***E21B 43/26*** | (2006.01) |
| ***E21B 49/00*** | (2006.01) |

(52) U.S. Cl.

CPC ..... *E21B 41/0092* (2013.01); *E21B 43/26* (2013.01); *E21B 49/00* (2013.01)

(58) Field of Classification Search

CPC ..... E21B 41/0092; E21B 43/26; E21B 49/00
See application file for complete search history.

(56) References Cited

U.S. PATENT DOCUMENTS

| | | | |
|---|---|---|---|
| 3,933,205 | A | 1/1976 | Kiel |
| 8,210,257 | B2 | 7/2012 | Disterhoft et al. |
| 8,733,444 | B2 | 5/2014 | East, Jr. et al. |
| 2012/0152550 | A1 | 6/2012 | East, Jr. |
| 2012/0325462 | A1 | 12/2012 | Roussel et al. |
| 2013/0186688 | A1 | 7/2013 | Rasmus et al. |
| 2014/0048270 | A1 | 2/2014 | Soliman et al. |
| 2014/0067353 | A1 | 3/2014 | Shelley et al. |
| 2015/0176394 | A1 | 6/2015 | Roussel et al. |
| 2016/0003020 | A1 | 1/2016 | Sharma |
| 2016/0196367 | A1 | 7/2016 | Petukhov |

FOREIGN PATENT DOCUMENTS

| | | | | |
|---|---|---|---|---|
| WO | 2016175844 | A1 | 11/2016 | |
| WO | WO-2016175844 | A1 * | 11/2016 | ..... E21B 43/26 |

OTHER PUBLICATIONS

Waters et al., Hydraulic Fracturing of Adjacent Horizontal Wells in the Woodford Shale, Hydraulic Fracturing Technology Conference, SPE 119635, Jan. 2009. (Year: 2009).*

Roussel N.P., et al., Optimizing Fracture Spacing and Sequencing in Horizontal-Well Fracturing, SPE International Symposium and Exhibition on Formation Damage Control, SPE 127986, May 2011.

(Continued)

*Primary Examiner* — Caroline N Butcher
(74) *Attorney, Agent, or Firm* — Boulware & Valoir

(57) ABSTRACT

A method for fracturing a well to improve productivity, by simulating zipper fracturing in such a way as to generate stress cages, thus minimizing anisotropy in a zone where fracture complexity is desired.

16 Claims, 13 Drawing Sheets

(56) References Cited

OTHER PUBLICATIONS

Gronseth M., Determination of the Instantaneous Shut in Pressure From Hydraulic Fracturing Data and Its Reliability As a Measure of the Minimum Principal Stress, American Rock Mechanics Association, 23rd US Symposium on Rock Mechanics, p. 183-189 (1982).
McLennan J.D & Roegiers J.C., How Instantaneous are Instantaneous Shut-In Pressures?, SPE 57th Annual Fall Technical Conference and Exhibition, SPE 11064, Sep. 1982.
Soliman, M.Y. et al., Methods for Enhancing Far-Field Complexity in Fracturing Operations, SPE Annual Technical Conference and Exhibition, SPE 133380, Sep. 2010.
Song J.H. et al., Preventing Mud Losses by Wellbore Strengthening, SPE Russian Oil and Gas Technical Conference and Exhibition, SPE 101593, Oct. 2006.
Rafiee M., et al., Hydraulic Fracturing Design and Optimization: A Modification to Zipper Frack, SPE Eastern Regional Meeting, SPE 159786, Oct. 2012.
Waters et al., Simultaneous Hydraulic Fracturing of Adjacent Horizontal Wells in the Woodford Shale, Hydraulic Fracturing Technology Conference, SPE 119635, Jan. 2009.
The International Search Report and the Written Opinion of the International Searching Authority of PCT/US2017/063360, dated Feb. 15, 2018.
Manchanda, R., and M. Sharma (2013), Time Dependent Fracture Interference Effects in Pad Wells, SPE 164534 presented at the SPE Unconventional Resource Conference, The Woodlands, Texas.
McClure, M., and D. Zoback (2013), Computational Investigation of Trends in Initial Shut-in Pressure during Multi-Stage Hydraulic Stimulation in the Barnett Shale, 47th US Rock Mechanics/Geomechanics Symposium held in San Francisco, California, ARMA 13-368.
Manchanda, R., N.P. Roussel, and M. Sharma (2012), Factors Influencing Fracture Trajectories and Fracturing Pressure Data in a Horizontal Completion, 46th US Rock Mechanics/Geomechanics Symposium held in Chicago, Illinois, ARMA 12-633.
Roussel, N.P., R. Manchanda, and M. Sharma (2012), Implications of Fracturing Pressure Data Recorded during a Horizontal Completion on Stage Spacing Design, SPE 152631 presented at the SPE Hydraulic Fracturing Technology Conference, The Woodlands, Texas.
Roussel, N.P., and M. Sharma (2011), Strategies to Minimize Frac Spacing and Stimulate Natural Fractures in Horizontal Completions, SPE 146104 presented at the SPE Annual Technical Conference and Exhibition, Denver, Colorado.
Vermylen, J., and M. Zoback (2011), Hydraulic Fracturing, Microseismic Magnitudes, and Stress Evolution in the Barnett Shale, Texas, USA, SPE 140507 presented at the SPE Hydraulic Fracturing Technology Conference, The Woodlands, Texas.
Soliman, M.Y., L. East, and D. Adams (2008), Geomechanics Aspects of Multiple Fracturing of Horizontal and Vertical Wells, SPE Drilling and Completions, 23(3), 217-228, SPE 86992-PA.
Far, et al., Interpretation of factures and stress anisotropy in Marcellus Shale using multicomponents seismic data, Interpreatation 2(2): SE 105-SE115, Apr. 2014.
Hayashi, et al., Interpreatation of Hydraulic Fracturing Shut-in Curves for Tectonic Stress Measurements, Int. J. Rock Mech. Min Sci & Geomech, Abstr. vol. 26, No. 6, pp. 477-482, 1989.
Paderin, et al., Multi-stage hydro-fracture trajectories: modelling by the SIE method, Procedia Materials Science vol. 3, 2014, pp. 1798-1803.
International Search Report for related case, App. No. PCT/US2017/63357, dated Feb. 15, 2018.

* cited by examiner

DESIGN

BASE SEQUENCE IS ZIPPER-FRAC OUTSIDE WELL SECTION FOLLOWED BY ZIPPER-FRAC INSIDE WELL SECTION

- NUMBER OF WELLS AND WELL SPACING: SIZE OF STRESS CAGE, FRAC LENGTH > WELL SPACING x (NUMBER OF WELLS-1)
- FRAC FLUID: XL OR SW FOR OUTSIDE WELLS (STRESS GENERATION), SW FOR INSIDE WELLS (COMPLEXITY)
- COMBINATION OF TREATMENT SIZE + PREF. CLUSTER SPACING + NUMBER OF PERF. CLUSTERS/STAGE: STRESS INDUCED BY ALL COMPLETIONS SHOULD OFFSET THE IN-SITU STRESS ANISOTROPY (STRESS TARGET)
- SIZE OF WELL SECTION FOR TREATMENT SEQUENCE (NUMBER OF STAGES/SECTION): DEPENDS ON LEAK-OFF BEHAVIOR (IF FAST, FAVOR SMALL WELL SECTIONS, IF SLOW, FAVOR LARGER WELL SECTIONS)

FIG. 3

MONITOR/ADJUST

UPDATE DESIGN ON THE FLY BASED ON FEEDBACK DURING STIMULATION, TO IMPROVE FRACTURE COMPLEXITY

- CHECK EVOLUTION OF STAGE ISIPs AND TREATING PRESSURES DURING COMPLETION, ADJUST TREATMENT SIZE OR WELL SECTION SIZE (NUMBER OF STAGES/SECTION) ACCORDINGLY
- CHECK DTS/MICROSEISMIC FOR COMPLEXITY GENERATION IF AVAILABLE
- ADJUST PUMPING RATE OR PROPPANT TYPE/CONCENTRATION TO EXPLOIT FRACTURE COMPLEXITY, i.e. INCREASE USE OF 100-MESH PROPPANT

FIG. 4

ZIPPER FRACK PATTERN, TWO PARALLEL HORIZONTAL WELLS FRACTURED AT THE SAME TIME, IN ZONE 1, THEN ZONE 2, THEN ZONE 3, ETC

ALTERNATING ZIPPER FRACK PATTERN, TWO PARALLEL HORIZONTAL WELLS FRACTURED IN THE PATTERN SHOWN ABOVE

MODIFIED ZIPPER FRACK PATTERN, LIKE THE ALTERNATING PATTERN, BUT FRACK ZONES ARE STAGGERED

INVENTIVE ZIPPER FRACK PATTERN, FRACK ZONES STAGGERED, AND OUTER WELLS FRACKED FIRST SO AS TO CREATE ISOTROPY NEAR THE INNER WALLS, ANISOTROPY ON OUTER WELLS, ADJACENT FRACK ZONES PREFERABLY STAGGERED BUT PATTERN CAN BE MODIFIED SO AS TO CONTROL ISOTROPY AS DESIRED

TWO FRACTURING SEQUENCES ON A SINGLE WELL: CONSECUTIVE (1-2-3-4-5) OR ALTERNATIVE (1-3-2-5-4)

ENGINEERED STRESS STATE WITH MULTI-WELL COMPLETIONS

PRIOR RELATED APPLICATIONS

This application claims priority to U.S. provisional application Ser. Nos. 62/427,262 and 62/427,280, both filed on Nov. 29, 2016. Each of these applications is incorporated herein in their entirety for all purposes.

FIELD OF THE DISCLOSURE

The disclosure generally relates to a method of improved hydraulic fracturing by engineering a favorable state of stress in a multiwell reservoir completion. Specifically, stress cages are used to control the stresses. By designing the timing, sequence and spacing of hydraulic fracturing operations across multiple wells to create a near-isotropic stress state, the degree of fracture complexity and the amount of surface area induced during fracturing operations will be greatly enhanced.

BACKGROUND OF THE DISCLOSURE

Hydraulic fracturing or "fracking" is the propagation of fractures in a rock layer by a pressurized fluid. The oil and gas industry uses hydraulic fracturing to enhance subsurface fracture systems to allow oil or natural gas to drain more freely from the reservoir to production wells that bring the oil or gas to the surface. However, there are many uses for hydraulic fracturing outside of the petroleum industry, including to stimulate groundwater wells, to precondition rock for cave in mining, to enhance waste remediation processes, to dispose of waste by injection into deep rock formations, including $CO_2$ sequestration, to measure the stress in the earth, and for heat extraction in geothermal systems.

In hydraulic fracturing, an injection fluid, usually including water or brine and often including a polymer, is injected into a reservoir at pressures high enough to fracture the rock. The two main purposes of fracturing fluid or "frack fluid" in oil reservoirs are to extend fractures in the reservoir and to carry proppants, such as grains of sand, into the formation. The purpose of the proppants is to hold the fractures open without damaging the formation or production of the well. The polymer is used to thicken the frack fluid, allowing it to more effectively carry the proppant deeper into the reservoir.

Without hydraulic fracturing, the time needed to drain a field would be inordinately long—in a tight field it could be in the order of hundreds of years. The only way to drain the oil in a reasonable time is to drill more wells—e.g., up to 40 wells per square mile in a tight field—a very expensive undertaking, or to fracture the field. The existence of long fractures allows the fields to be drained in a reasonable time period, with fewer wells, and in a cost effective way.

Since Stanolind Oil introduced hydraulic fracturing in 1949, close to 2.5 million fracture treatments have been performed worldwide. Some believe that approximately 60% of all wells drilled today are fractured. Fracture stimulation not only increases the production rate, but it is credited with adding to reserves—9 billion bbl of oil and more than 700 Tscf of gas added since 1949 to US reserves alone—which otherwise would have been uneconomical to develop. In addition, through accelerating production, net present value of reserves has increased.

In 1976, Othar Kiel started using high-rate "hesitation" fracturing to cause what he called "dendritic" fractures— with tree-like branching patterns. The method was invented from the observation of unusually good production increases from a number of wells that had been temporarily shut in due to equipment failures. Since the two groups of wells differed primarily in a single factor—an inadvertent shut-down period—another group of wells was selected for controlled tests of this factor, and it was found that when an intentional shut-down period of one hour was put in the frack plan, the first month's production was about double.

The U.S. Pat. No. 3,933,205 Kiel patent describes the method, now known as the "Kiel process" or "dendritic fracturing." The process uses cyclic injections to form extraordinarily long, branching flow channels. Fracturing pressures induce spalling (flaking of rock fragments) from the fracture faces. When the well is shut in and then reinjected, the fluid movement moves the debris to the ends of the fractures, causing increased pressures at the end, and thus further propagating the fracture in a direction perpendicular to the initial fracture. Repeated cycles cause further branching. The transverse fractures will eventually intersect and communicate with natural fractures that parallel the direction of the primary fracture, thus a fully branched drainage system is developed. Further improvement can be had if the wells are opened for reverse flow during the shut-down period.

The Kiel method has been applied with good results to a wide range of formations at depths to 11,500 ft. Most of more than 400 dendritic (branching) fracturing jobs performed since the 70's have shown sustained productivity increases of 2-5 times those generated by conventional fracturing.

Since then, other methods have been developed to improve fracturing. U.S. Pat. No. 8,733,444, for example, describes improving fracturing by introducing a wellbore servicing apparatus configured to alter (decrease) the stress anisotropy of the fracturing interval of the subterranean formation, altering the stress anisotropy within the fracturing interval, and introducing a fracture in the fracturing interval in which the stress anisotropy has been altered. U.S. Pat. No. 8,210,257 describes a similar method, but wherein the method includes a signaling subsystem adapted to transmit control signals from a well bore surface to each injection tool to change the state of the injection tool.

US20140048270 describes a method of hydraulically fracturing parallel lateral wellbores such that the fractures from alternating sides meet in a zipper like fashion, altering the stress fields thereby and providing complex fractures in the region of near overlap.

Although hydraulic fracturing is quite successful, even incremental improvements in technology can mean the difference between cost effective production and reserves that are uneconomical to produce. Therefore, there is always the need for better methods of hydraulic fracturing.

SUMMARY OF THE DISCLOSURE

The first-order parameters impacting the propagation of hydraulic fractures, and the amount of surface area contacted during hydraulic stimulation, can be grouped in three major categories: rock fabric, completion design, and stress state. While part of the state of stress is inherited from the geological context (in-situ stresses), it is also well established that well operations (stimulation or production) may alter the state of stress in the reservoir. More specifically, the difference between minimum and maximum horizontal stress (also called horizontal stress anisotropy), impacts how induced fractures interact with planes of weakness naturally present in the formation.

There is extensive evidence in the literature that for an elevated value of the horizontal stress anisotropy, tensile branching of induced fractures along natural fractures is impeded, thus preventing fracture complexity and ultimately decreasing the surface area contacted by the hydraulic stimulation. For instance, the Niobrara formation is thought to exhibit a high value of stress anisotropy (around 1500 psi), contrasting with the Barnett shale, which is in a near-isotropic stress state.

The proposed completion methods herein aim at sequencing fracturing operations across multiple wells to engineer a favorable state of stress in order to:

1. Increase fracture complexity by changing horizontal stresses to a near-isotropic state.

2. Create horizontal containment of fracture propagation through stress cage mechanisms.

3. Increase isolation of subsequent stages for each well, and reduce fracture stage overlap.

4. Increase the surface area contacted by the stimulation, and to improve ultimate recoveries.

The workflow for the proposed method includes:

1. Evaluation of the in-situ stress anisotropy using e.g., the ISIP Escalation Analysis disclosed in Application Ser. No. 62/427,262 (42328US01).

2. Design the completion (i.e. fluid type, pump rate, volume), perforation cluster and stage spacing, and fracture sequence of a multiwell, multistage fracturing program to offset the evaluated or predicted in-situ stress anisotropy and create a near-isotropic stress regime for the middle wells in the fracture sequence.

3. Evaluation of the final state of stress after n stages, and adjust the fracturing design as needed to control the fracture network and/or its generated complexity.

After the fracturing parameters are optimized using the workflow, remaining steps in the method include implementing the completion parameters and producing hydrocarbons. Thus, the updated model parameters, such as well spacing, cluster size and spacing, are being utilized to design, optimize and execute the fracture stimulation.

The proposed completion method consists of engineering a state of stress that is conducive to creating a material increase in fracture complexity and contacted surface area, which is believed to be the key driver in achieving higher ultimate recoveries. Well proximity and the prescribed timing and spatial location of hydraulic fracture stimulation serve as the essential elements of the inventive methods.

The present disclosure also relates to a computing apparatus for performing the operations described herein. This apparatus may be specially constructed for the required purposes of modeling, or it may comprise a general-purpose computer selectively activated or reconfigured by a spreadsheet program and reservoir simulation computer program stored in the computer. Such computer programs may be stored in a computer readable storage medium, preferably non-transitory, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

In one embodiment, the computer system or apparatus may include graphical user interface (GUI) components such as a graphics display and a keyboard, which can include a pointing device (e.g., a mouse, trackball, or the like, not shown) to enable interactive operation. The GUI components may be used both to display data and processed data and to allow the user to select among options for implementing aspects of the method or for adding information about reservoir inputs or parameters to the computer programs. The computer system may store the results of the system and methods described above on disk storage, for later use and further interpretation and analysis. Additionally, the computer system may include on or more processors for running said spreadsheet and simulation programs.

Hardware for implementing the inventive methods may preferably include massively parallel and distributed Linux clusters, which utilize both CPU and GPU architectures. Alternatively, the hardware may use a LINUX OS, XML universal interface run with supercomputing facilities provided by Linux Networx, including the next-generation Clusterworx Advanced cluster management system.

Another system is the Microsoft Windows 7 Enterprise or Ultimate Edition (64-bit, SP1) with Dual quad-core or hex-core processor, 64 GB RAM memory with Fast rotational speed hard disk (10,000-15,000 rpm) or solid state drive (300 GB) with NVIDIA Quadro K5000 graphics card and multiple high resolution monitors.

Slower systems could also be used because the processing is less computation intensive than for example, 3D seismic processing.

The disclosed methods include one or more of the following embodiments, in any combination(s) thereof:

A method of improving hydrocarbon recovery using hydraulic fracturing in a reservoir by inputting one or more fracture parameters into a reservoir model stored in a non-transitory memory of a computer; inputting one or more well parameters into a reservoir model stored in a non-transitory memory of a computer; inputting one or more reservoir rock parameters into a reservoir model stored in a non-transitory memory of a computer; inputting a fracture sequence into the reservoir model, wherein the fracture sequence utilizes multiple wells and multiple fracturing stages, wherein multiple wells include outer and inner wells, wherein the fracture sequence further comprises zipper fracturing the outer wells before zipper fracturing the inner wells; simulating the reservoir model to predict a fracturing outcome; interpreting the fracture outcome to determine horizontal stress anisotropy, stress cage generation, and/or fracture complexity for one or more fractured zones; iteratively updating the fracture parameters and well parameters and re-simulating the reservoir model to decrease or minimize the horizontal stress anisotropy, increase the stress cage generation or modify the fracture complexity in one or more fracture zones in the fracture outcome; and; implementing the re-simulated reservoir model in the reservoir.

A method of improving hydrocarbon recovery using hydraulic fracturing in a reservoir by inputting one or more fracture parameters into a reservoir model stored in a non-transitory memory of a computer; inputting one or more well parameters into the reservoir model stored in a non-transitory memory of a computer; inputting one or more reservoir rock parameters into a reservoir model stored in a non-transitory memory of a computer; inputting a fracture sequence into the reservoir model, wherein the fracture sequence utilizes multiple wells and multiple fracturing stages, wherein the multiple wells include outer and inner wells, wherein the fracture sequence further comprises zipper fracturing a section or totality of the outer wells before zipper fracturing a section or totality of the inner wells; simulating the reservoir model to predict a fracturing outcome, wherein the reservoir model is a multistage fracturing plan; implementing the fracturing plan of the simulated reservoir model in the reservoir; evaluating each stage of the multistage fracturing plan using DTS, production data, production interference test, downhole gauges, microseismicity, and instantaneous shut-in pressure; iteratively updating the fracture parameters and well parameters and re-simulating the reservoir model after each stage to decrease or minimize the horizontal stress anisotropy, increasing stress cage generation or modifying the fracture complexity in one or more fracture zones in the fracture outcome; and implementing the re-simulated reservoir model in the reservoir.

Any of the above methods can further include the step of producing hydrocarbons. Hydrocarbon production is expected to be more efficient given the optimized fracture plan that was implemented using the inventive methods.

In any of the above methods, the updating step includes minimizing the horizontal stress anisotropy and increasing fracture complexity in the same fracture zone or minimizing the horizontal stress anisotropy, increasing the stress cage generation and increasing fracture complexity in the same fracture zone.

In any of the above methods, the reservoir can undergo different zipper fracturing, including nested zipper fracturing, alternating zipper fracturing, staggered zipper fracturing or combination thereof.

In any of the above methods, the reservoir rock parameters can include one or more of the following: magnitude and direction of in-situ principal stresses (including overburden stress, minimum closure stress and maximum horizontal stress), rock density, rock porosity, rock permeability, rock mineral content, rock laminations, density and length of natural fractures and mechanical properties, such as Young's modulus and/or Poisson ratio.

In any of the above methods, the fracture parameters can include one or more of the following: number of fracture stages, number of perforation clusters per stage, an order of fracturing for each stage, a fracture treatment rate or pressure for each stage, a fracturing fluid for each stage, a proppant type for each stage, a proppant density for each stage, a perforation cluster spacing and/or a perforation density for each stage, calculated horizontal stress anisotropy for each stage, calculated stress plateau, fracture density, and/or fracture height.

In some embodiments, the fracture parameters are calculated using the instantaneous shut-in pressure (ISIP) analysis in a similar well in said reservoir or in the target well(s). The ISIP analysis can be performed for a variety of fluid types, slurry volumes, proppant types, proppant mass, proppant concentrations, and/or injection rates.

In any of the above methods, the well parameters can include one or more of the following: well number, well length and diameter, well spacing, well orientation, reservoir pressure, and fluid PVT properties.

In any of the above methods, the iteratively updating step includes minimizing the horizontal stress anisotropy, increasing the stress cage generation, increasing fracture complexity, or combinations thereof in the same or different fracture zone.

Any method described herein, further including the step of using said results in a reservoir modeling program to predict fracturing, production rates, total production levels, rock failures, faults, wellbore failure, and the like.

Any method described herein, further including the step of using said results to design and implement a hydraulic fracturing program, and ultimately to produce oil or other hydrocarbon.

A non-transitory machine-readable storage medium, which when executed by at least one processor of a computer, performs the steps of the method(s) described herein.

Any method described herein, including the further step of printing, displaying or saving the results of the method.

A printout or 3D display of the results of the method.

A non-transitory machine-readable storage medium containing or having saved thereto the results of the method.

"Fracing" or "Fracking", as used herein, may refer to any process used to manually initiate and propagate a fracture in a rock formation, but excludes natural fracking. Additionally, fracking may be used to increase existing fractures in a rock formation. Fracking may include forcing a hydraulic fluid in a fracture of a rock formation to increase the size of the fracture and introducing proppant (e.g., sand) in the newly induced fracture to keep the fracture open. The fracture may be an existing fracture in the formation, or may be initiated using a variety of techniques known in the art. "Hydraulic Fracking" means that pressure was applied via a fluid.

As used herein, the "principal horizontal stress" in a reservoir refers to the minimum and maximum horizontal stresses of the local stress state at depth for an element of formation. These stresses are normally compressive, anisotropic and nonhomogeneous.

As used herein, "anisotropic stress" means the stress values are different in different directions.

As used herein, "isotropic stress" means the stress values are the same in different directions.

As used herein a "fracture model" refers to a software program that inputs well, rock and fracturing parameters and simulates fracturing results in a model reservoir. Several such packages are available in the art, including SCHLUMBERGERS® PETREL® E&P,FRACCADE® or MANGROVE® software, STIMPLAN™, tNAVIGATOR™, SEEMYFRAC™, TERRAFRAC™, ENERFRAC®, PROP®, FRACPRO™, and the like. Add GOHFER® (Barree & Associates LLC) For shale reservoirs, FRACMAN™ and MSHALE™ may be preferred. These models can be used with appropriate plugins or modifications needed to practice the claimed methods.

By "fracture pattern", we refer to the order in which the frack zones are fractured.

The term "zipper fracturing" refers to sequentially fracturing at least two parallel wells either simultaneously or alternatingly (first one well, then the other). In other words, in simultaneous zipper fracturing, stage 1 of both wells are done at the same time, then stage 2 of both wells, etc. The term "alternating" with respect to zipper patterns means that the adjacent wells are sequentially fracked. Thus, in alternating zipper fracturing, fracturing occurs at stage 1 on well one, then the parallel stage on well two, then fracturing begins at the stage 2 on well one, then the parallel stage on well two, and so forth.

The "Texas Two-Step" pattern, also called "alternating fracturing", is not a type of zipper-frack pattern. It is a type of fracture sequence used on a single well, which consists in skipping hydraulic stimulation of intervals of the well on the first run through, and then coming back and stimulating these skipped intervals in-between existing frack stages.

This technique requires special completion tools, and cannot be used in plug & perf completions that are described here (see e.g. SPE 127986 and SPE 133380).

The term "staggered" with respect to zipper fracturing patterns means that frack zones on adjacent wells are positioned so that one frack zone of well one falls between two frack zones on well two. Thus, the perforation clusters are staggered, and the fractures themselves will be interleaved.

The term "nested zipper fracturing" refers to fracturing two outer parallel horizontal wells, either simultaneously or alternatingly, prior to the stimulation of either one inner horizontal well or the zipper fracturing of two or more inner horizontal wells The term "leapfrog" refers to the execution of a nested zipper fracturing sequence over a partial section of the three or more horizontal wells (2 outer wells+1 or more inner wells). As a result, hydraulic stimulation of the inner horizontal wells start before the hydraulic stimulation of all the outer horizontal-well stages is completed. The nested zipper fracturing sequence may be repeated until the parallel horizontal wells are stimulated across their entire length. The size of the leapfrog section and number of stages associated with it is designed to induce a certain level of stress.

As used herein, "instantaneous shut-in pressure" or "ISIP" is the final injection pressure excluding the pressure drop due to friction in the wellbore and perforations or slotted liner. There are numerous ways to estimate ISIP, any of which can be used hereunder, but the preferred method records the pressure value past the early rapid falloff. Water hammer occurs following shut-in, and common practice is to extrapolate the slope at the end of the water hammer to the shut-in time.

ISIPs escalate from toe to heel in all wells as a result of the mechanical interference induced by hydraulic fractures often referred to as "stress shadowing". However, the ISIP typically reaches a "stress plateau" after the first couple of stages. The magnitude of the stress plateau is the total increase in minimum principal stress induced by horizontal-well stimulation (from the ISIP Analysis).

"ISIP Analysis" refers to the methods disclosed in Application Ser. No. 62/427,262, filed Nov. 29, 2016, and used herein to match the ISIP escalation during a multi-stage plug-and-perf completion with developed analytical equations and type-curves to obtain fracturing information such as fracture height, length, and area and the horizontal stress anisotropy.

Typically, the ISIP analysis is performed on a similar well in the vicinity of the target multi-well test area. These prior evaluations of hydraulic fracture dimensions and in-situ horizontal-stress anisotropy are then used to develop the fracturing methods in the test well(s).

A "water hammer" is used in accordance with its art accepted meaning of a pressure transient. A pressure transient is generated when a sudden change in injection rate occurs due to a valve closure or injector shutdown. This pressure transient—referred to as a water hammer—travels down the wellbore, is reflected back and induces a series of pressure pulses on the sand face.

As used herein, a "stress cage" refers to a far-field stress cage in which the outside wells (see FIG. 5), by increasing the minimum horizontal stress during their fracturing operations, contribute to constrain transverse propagation of the middle-well hydraulic fractures. This, in turn, increases the interaction with natural fractures even more.

Hydraulic fractures tend to propagate laterally over significant distances (in the range of thousands of feet). The stress cage described herein focuses that energy closer to the wells (especially the middle ones), thus increasing the effectiveness of the hydraulic fracturing process. 'Stress cage' does not refer to the hoop stresses in the near wellbore region, which may impact fracture initiation.

As used herein, "escalation number" refers to number of stages after which induced stresses are equal to some pre-determined arbitrary percentage of the stress plateau. It is independent of the stress load.

By "in-situ closure stress", the in-situ minimum horizontal stress as hydraulic fractures propagate perpendicular to the minimum horizontal stress direction. When the pressure in the fracture is greater than the fracture-closure pressure, the fracture is open.

By "stress load", we refer to the net pressure in the hydraulic fracture(s) of one stage just prior to the start of the subsequent stage, which is the source of induced stress interference. Factors influencing the magnitude of the stress load include:

- Volume of the slurry pumped during the stage
- Fracture geometry (height, length, number of perforation clusters)
- Mechanical properties (Young's modulus, Poisson's ratio)
- Resting time between consecutive stages
- Leak-off coefficient Residual load exists as the fracture fluids leaks off and the fracture faces close on the proppant, which is a function of the "closure load" (i.e. amount of proppant/stage).

"Stress interference" refers to stresses that interfere in the fracture propagation and result in reorientation of a fracture. Stress interference phenomena have tremendous diagnostic value as they relate to the: 1) geometry of the induced fractures (height) and 2) in-situ stresses. The stress interference increases with each new fracturing stage.

The "interference ratio" is defined as:

$$\text{Interference Ratio} = \frac{\Delta\sigma_{plateau}}{\sigma_{load} \times \text{Escalation}}$$

and represents the relative magnitude of stress interference between subsequent stages, which is always between 0 and 1. The tighter the stage spacing the larger the induced stress plateau is for a given value of the escalation number.

"Type-curves" as used in the ISIP Analysis for evaluation of parameters used in the methods disclosed, refer to those graphs built by matching analytical models of multi-stage mechanical stress interference with the following stress equation:

$$\Delta\sigma_{shadow}(n) = \Delta\sigma_{plateau}\left(1 - \frac{1-n}{e^{Escalation}}\right)$$

The response of the type-curves can also be described using correlation equations for ease of calculations. See Application Ser. No. 62/427,262. No additional type-curves need to be prepared for the methods herein.

"Match curves" as used herein, refer to a least squares regression analysis of collected shut-in pressure. The $\Delta\sigma_{plateau}$ and escalation number are varied until a solution to the equation below that minimizes the difference in the square error of the regression and collected pressure is found.

The term "fracture complexity" refers to the degree of entanglement (or lack thereof) in the induced fractures.

Fractures can range from simple planar fractures to complex planar fractures and network fracture behavior. Further, the fracture complexity can change from near-well, mid-field, and far-field regions.

The term "many-core" as used herein denotes a computer architectural design whose cores include CPUs and GPUs. Generally, the term "cores" has been applied to measure how many CPUs are on a giving computer chip. However, graphic cores are now being used to offset the work of CPUs. Essentially, many-core processors use both computer and graphic processing units as cores.

The optimized model with updated parameters are implemented into the fracturing program to recover hydrocarbons.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| $\Delta\sigma_{Plateau}$ | Magnitude of the stress plateau |
| $\Delta\sigma_H$ | Horizontal stress anisotropy ($\sigma h_{max} - \sigma h_{min}$) |
| DTS | Distributed Temperature Sensing |
| E | static Young's modulus |
| Escalation | Stress escalation number |
| $h_f$ | Fracture half-height |
| Interference | Interference Ratio |
| ISIP | instantaneous shut-in pressure |
| $L_f$, $x_f$ | Fracture half-length |
| $n_{well}$ | number of wells |
| $P_p$ | Pore pressure |
| Psi | Pounds per square inch |
| $s_{cluster}$ | Spacing between perforation clusters |
| SRV | Stimulated Reservoir Volume |
| SW | Slickwater |
| $s_{well}$ | Interwell distance along a horizontal axis |
| UCS | Uniaxial compressive strength |
| $V_{slurry}$ | Slurry volume per frack stage |
| XL | Cross-linked gels |
| $\varepsilon_H$ and $\varepsilon_h$ | Tectonic strains in maximum and minimum horizontal stress directions respectively |
| v | Poisson's ratio |
| $\sigma_{hmax}$ | Maximum horizontal stress |
| $\sigma_{hmin}$ | Minimum horizontal stress or closure stress |
| $\sigma_{load}$ | Stress load (ISIP Analysis) |
| $\sigma_v$ | Overburden stress |

BRIEF DESCRIPTION OF THE DRAWINGS

FIG. 3: Design.

FIG. 4: Monitor and adjust.

DETAILED DESCRIPTION

Figure 1:
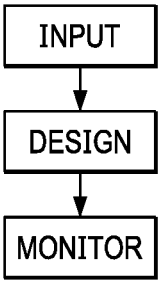
FIG. 1: Overall workflow: input>design>monitor.

During hydraulic fracture propagation, three regions may be identified from the pressure response and are referred to as: 1) near-well, that extends tens of inches; 2) mid-field, that extends tens of feet; and 3) far-field, that extends hundreds of feet from the wellbore. Each region can experience simple, tortuous, and complex fracture behavior creating unique pressure signatures.

For decades the oil industry has struggled to overcome near-wellbore fracture complexity during fracturing treatments, particularly in low-permeability, naturally fractured hard-rock reservoirs, because complexity near the wellbore reduces penetration of the fracture deeper into the reservoir. Yet at the same time, complexity is desired further away from the wellbore in order to sufficiently increase contact and drainage. A number of techniques have been created to diagnose and remediate these conditions to enable extension of created fractures and successful placement of proppant deep in the reservoir.

Horizontal wells with multiple fractures are now commonly used in unconventional (low-permeability) gas reservoirs. The spacing between perforations and the number and orientation of transverse fractures all have a major impact on well production.

The opening of propped fractures results in the redistribution of local earth stresses. In SPE-127986-PA, the extent of stress reversal and reorientation was calculated for fractured horizontal wells using a 3D numerical model of the stress interference induced by the creation of one or more propped fractures. The results were analyzed for their impact on simultaneous and sequential fracturing of horizontal wells. The data demonstrated that a transverse fracture initiated from a horizontal well may deviate away from the previous fracture. The effect of the reservoir's mechanical properties on the spatial extent of stress reorientation caused by an opened crack was quantified. The paper takes into account the presence of layers that bound the pay zone, but have mechanical properties different from those of the pay zone. The fracture vertical growth into the bounding layers was also examined.

It was shown that stress interference, or reorientation, increases with the number of fractures created and depends on the sequence of fracturing. Three fracturing sequences were investigated for a typical field case in Barnett shale: (a) consecutive fracturing, (b) alternative fracturing, and (c) simultaneous fracturing of adjacent wells. The numerical calculation of the fracture spacing required to avoid fracture deviation during propagation, for all three fracturing techniques, demonstrated the potential advantages of alternate fracture sequencing and zipper fracks to improve the performance of stimulation treatments in horizontal wells.

This disclosure takes fracturing methodology even further, providing a method of actually engineering (controlling) the stress patterns in multi-well completions in order to control the fracture pattern. In a nutshell, the proposed multi-well sequencing workflow disclosed herein is a technology that enables fracture complexity generation at a cheaper price than the normal remedy of increasing the number of perforation clusters per well.

Herein, we have used fracture plan design to create far-field stress cages and thereby to lower stress anisotropy and increase fracture complexity in that region. Generally speaking, we employed zipper fracture patterns in multi-well parallel horizontal completions, first fracturing all of the outer wells in an alternating pattern—fracturing first on one side then the other, then fracturing the inner wells, again in an alternating manner, such that we fracture first one side then the other.

FIG. 1 illustrates the overall workflow of the inventive method, including inputting the needed parameters for the fracture plan, designing and implementing the fracture plan, and monitoring and adjusted the fracture plan as needed using data that is collected during the ongoing hydraulic fracturing stimulation.

Figure 2:
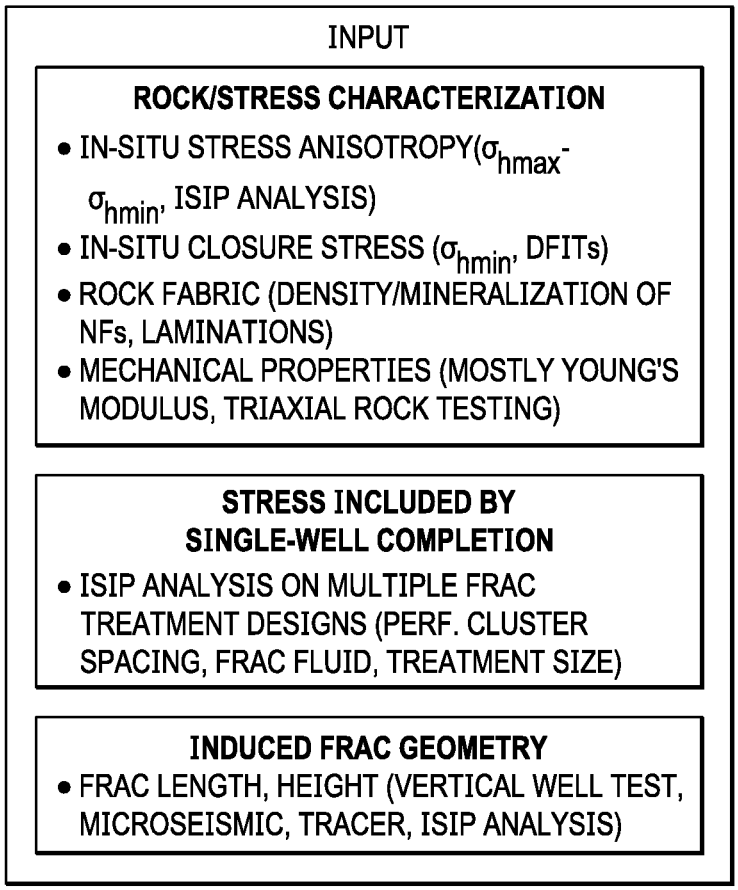
FIG. 2: Exemplary input parameters.

In more detail, FIG. 2 shows exemplary parameters that are inputted into a model contained in a non-transitory computer readable medium. The input parameters include rock/stress characterization parameters, such as in-situ stress anisotropy ($\sigma_{hmax}-\sigma_{hmin}$, ISIP analysis); in-situ closure stress ($\sigma_{hmin}$, DFITs); rock fabric (density/mineralization of NFs, laminations); and mechanical properties (mostly Young's modulus, Poisson's ratio, triaxial rock testing).

Also inputted are stresses induced by a fracturing stage ($\sigma_{load}$), which is strongly influenced by slurry volume ($V_{slurry}$), the number of perforation clusters per stage, spacing between perforation clusters, and stresses induced by a multi-stage horizontal-well completion ($\Delta\sigma_{plateau}$), such as ISIP analysis on multiple fracture treatment designs (perforation cluster spacing, frack fluid, treatment size, and the like).

Also inputted is induced frack geometry, including such factors such as fracture length, height (vertical well test, microseismic, tracer, ISIP analysis, and the like).

Many of these parameters are known from characterization tests typically run of target wells in a reservoir. However, others parameters have to be obtained using additional testing.

One method of obtaining many of these input parameters is through the use of the ISIP analysis described in Application No. 62/427,262, filed Nov. 29, 2016. As this analysis is described elsewhere, we will not go into detail as to how the analysis proceeds.

The ISIP analysis is a method for evaluating the hydraulic fracturing for every well being hydraulically stimulated at every stage and estimates some of the most important uncertainties associated with hydraulic fracturing, especially in shale reservoirs: 1) hydraulic-fracture height, length and induced fracture area; 2) horizontal-stress anisotropy ($\sigma_{hmax}-\sigma_{hmin}$); and 3) Induced stress plateau ($\Delta\sigma_{plateau}$)—The horizontal-stress anisotropy in particular plays a key role in the ability to generate complexity in the fracture network. Thus, this parameter is an important part of the input step.

In determining the input parameters with the ISIP analysis, it is important to compare the amount of in-situ stress anisotropy ($\sigma_{hmax}-\sigma_{hmin}$) to the stress induced by a single-well completion ($\Delta\sigma_{plateau}$). If $\sigma_{hmax}-\sigma_{hmin}$ is less than $\Delta\sigma_{plateau}$, sequencing fractures across multiple wells may not be essential to generate complexity. In the case of wells in the Shale I formation, $\sigma_{hmax}-\sigma_{hmin}$ is approximately 1.65 times the $\Delta\sigma_{plateau}$ (i.e. $\sigma_{hmax}-\sigma_{hmin}>\Delta\sigma_{plateau}$) and requires sequencing fractures across multiple wells to reach an anisotropic stress state.

Another important consideration is the impact that completion parameters can play on the stress induced by a single-well completion. In some optimizations, instead of placing perforations clusters very close to each other to generate more stress (higher $\Delta\sigma_{plateau}$) in order to lower stress anisotropy and increase complexity, it may be more economically beneficial to reduce the cluster spacing, but sequence fractures across multiple wells.

The ISIP analysis described in Application No. 62/427,262 calculates hydraulic fracture dimensions and in-situ horizontal stress anisotropy from the escalation of instantaneous shut-in pressures in a multi-stage horizontal completion for each well using only data that is systematically reported after every plug and perforation multi-stage completion. The shut-in pressure and a series of type-curves are then used to estimate fracture variables that are typically hard to determine, including horizontal-stress anisotropy. From there, an operator can determine if there is significant fracture overlap and inefficient recovery.

After the anisotropy evaluation and inputting step, the next step is fracture design. FIG. 3 shows the basic design principles used in generating the fracture plan. The basic sequence is to zipper-frack an outside well section, followed by zipper-frack inside well section. However, additional information such as fluid selection, proppant selection, and clustering number and spacing are also important for the design.

The number of wells and well spacing are important to the design. The hydraulic fracture from the outside well should reach at least the middle point of the multi-well configuration, so that the entire zone in between the outside wells benefits from the engineered stress regime. The acceptable stress regime corresponds to $L_f>2*S_{well}*(n_{well}-1)$, wherein $L_f$ is the fracture half-length, $S_{well}$ is the well spacing, and $n_{well}$ is the number of wells.

Frack fluid selection is also important, and varies for outside wells versus inside wells. Frack fluid comprising XL (cross-linked gels) or SW (Slickwater) is typically for outside wells for stress cage generation, and SW by itself is used for inside wells to generate fracture complexity.

Combination of treatment size, perforation cluster spacing and the number of perforation clusters per fracture stage is also managed such that the stress induced by all completions is able to offset the in-situ stress anisotropy (stress target).

The size of well section for treatment sequence (e.g., number of stages/section): depends on leak-off behavior: if fast, one favors small well sections, if slow, larger well sections can be used.

Using the above parameters, the fracturing results can be simulated by software on the computer. The design parameters are then varied in order to optimize the results, according to the above principles. Particularly, the variables can be modified to decrease horizontal-stress anisotropy and improve fracture complexity in the far field. Thus, per FIG. 4, the design can be updated based on feedback from the simulations to improve fracture complexity.

Thus, the evolution of each stage of the plug and perf can be analyzed with the ISIP analysis, the generated fracture complexity can be monitored by the DTS or microseismic results, and the pumping rate for fracking fluids and/or proppants can similarly be adjusted to exploit the fracture complexity.

Figure 5:
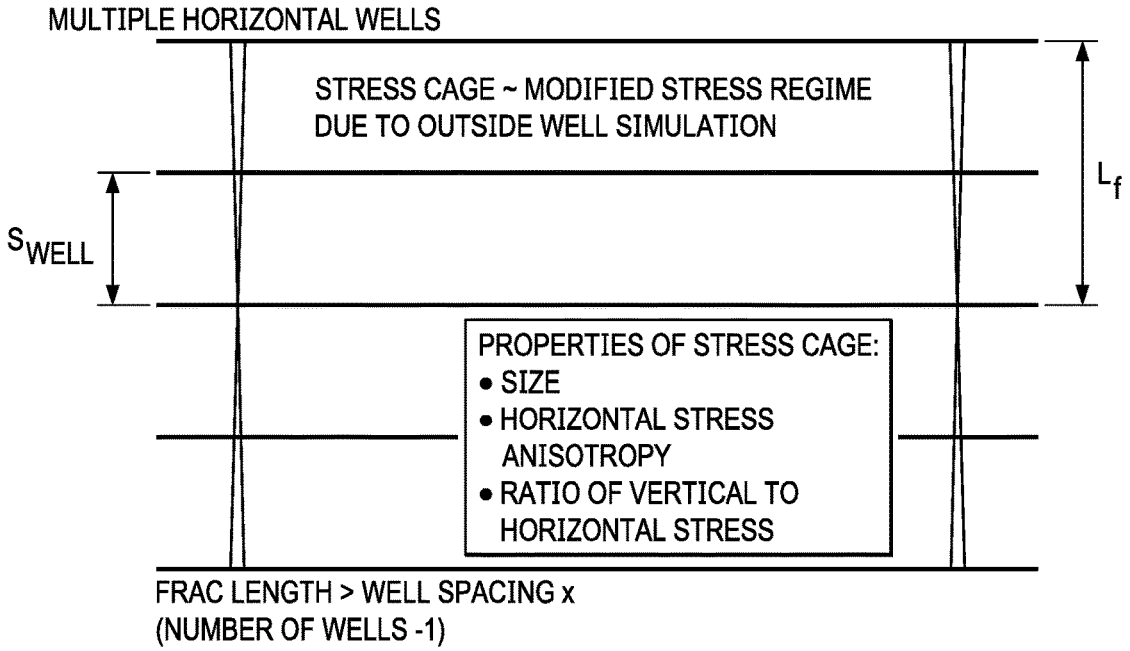
FIG. 5: Stress cage generation generally.

FIG. 5 shows the general stress cage generation of multi-well (5) shown from a top plan view. $S_{well}$ is the interwell horizontal distance, $L_f$ is the half-length of the fracture. In general, the fracture length should be greater than the well spacing $S_{well}$ times the number of wells minus one. This is shown by the cones in FIG. 5. Each cone represents half of a hydraulic fracture (the other half propagating symmetrically in the other direction) and needs to reach 2 times the well spacing, in the case of a 5-well pad.

Figure 6A:
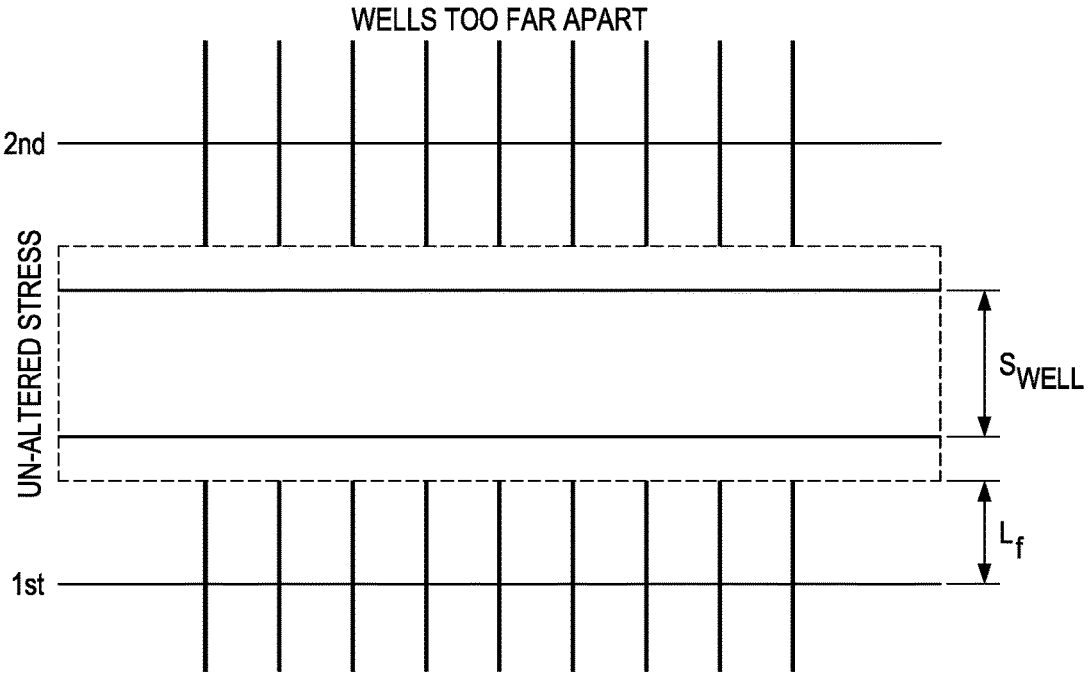
FIG. 6A-C: Displays diagrams of wells that are two far apart (6A), too close (6B) and properly spaced (6C).
Figure 6B:
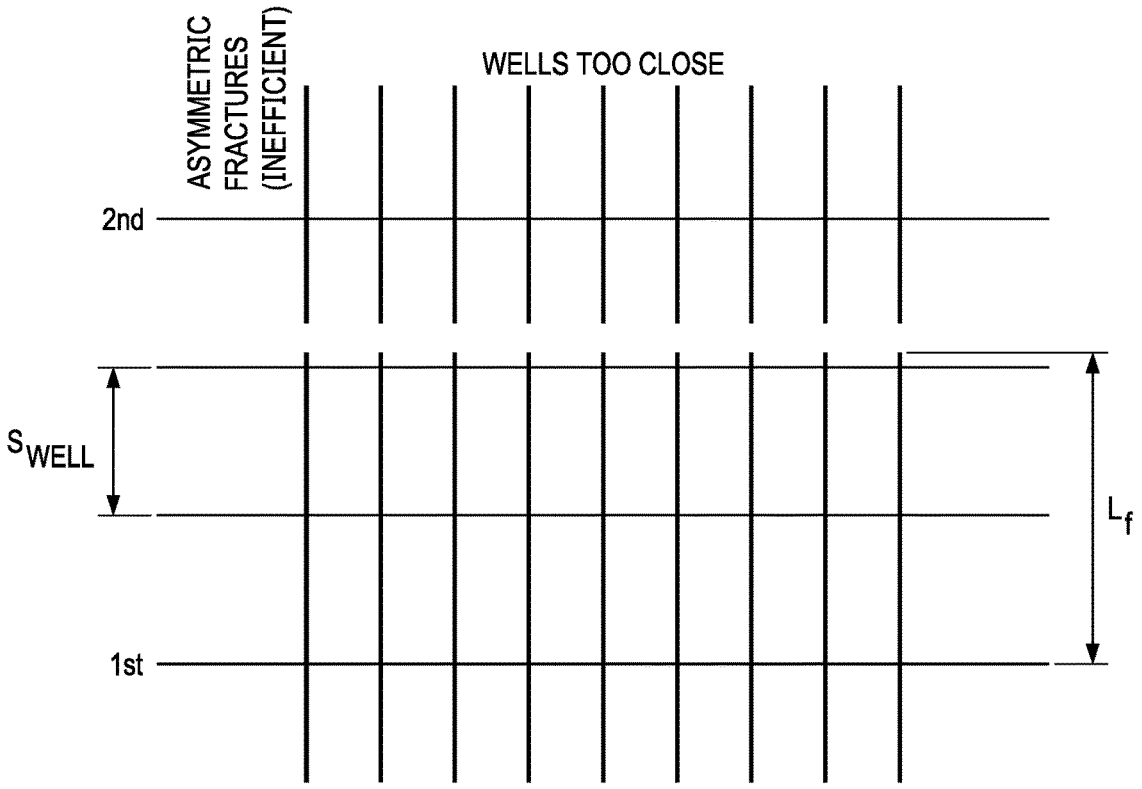
Figure 6C:
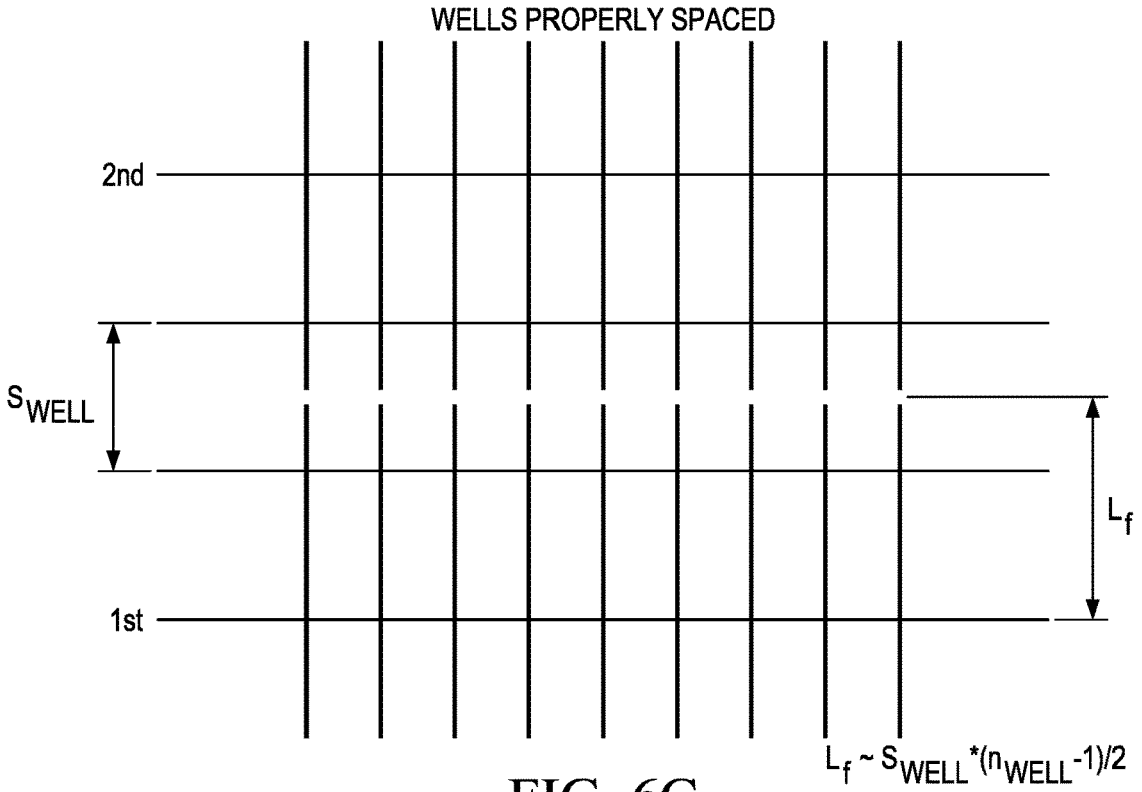

To further illustrate this point, FIG. 6A-C displays diagrams of wells that are two far apart (6A), too close (6B) and properly spaced (6C). One of the objectives during the design step of the described methods is to adjust the well spacing and/or number of wells in the fracture sequence, so that the fractures induced from the outside well can alter the stress regime everywhere in-between the outside wells. That is why the well spacing and number of wells depend on fracture length. If the wells are spaced too far apart, there will be a zone in the middle out of reach of the outside-well fracks, which will not benefit from the altered-stress regime. On the other hand, if the wells are too close, the hydraulic stimulation from one of the outside wells may cause the fractures from the other outside wells to propagate in an asymmetric fashion, away from the other wells.

Figure 7A:
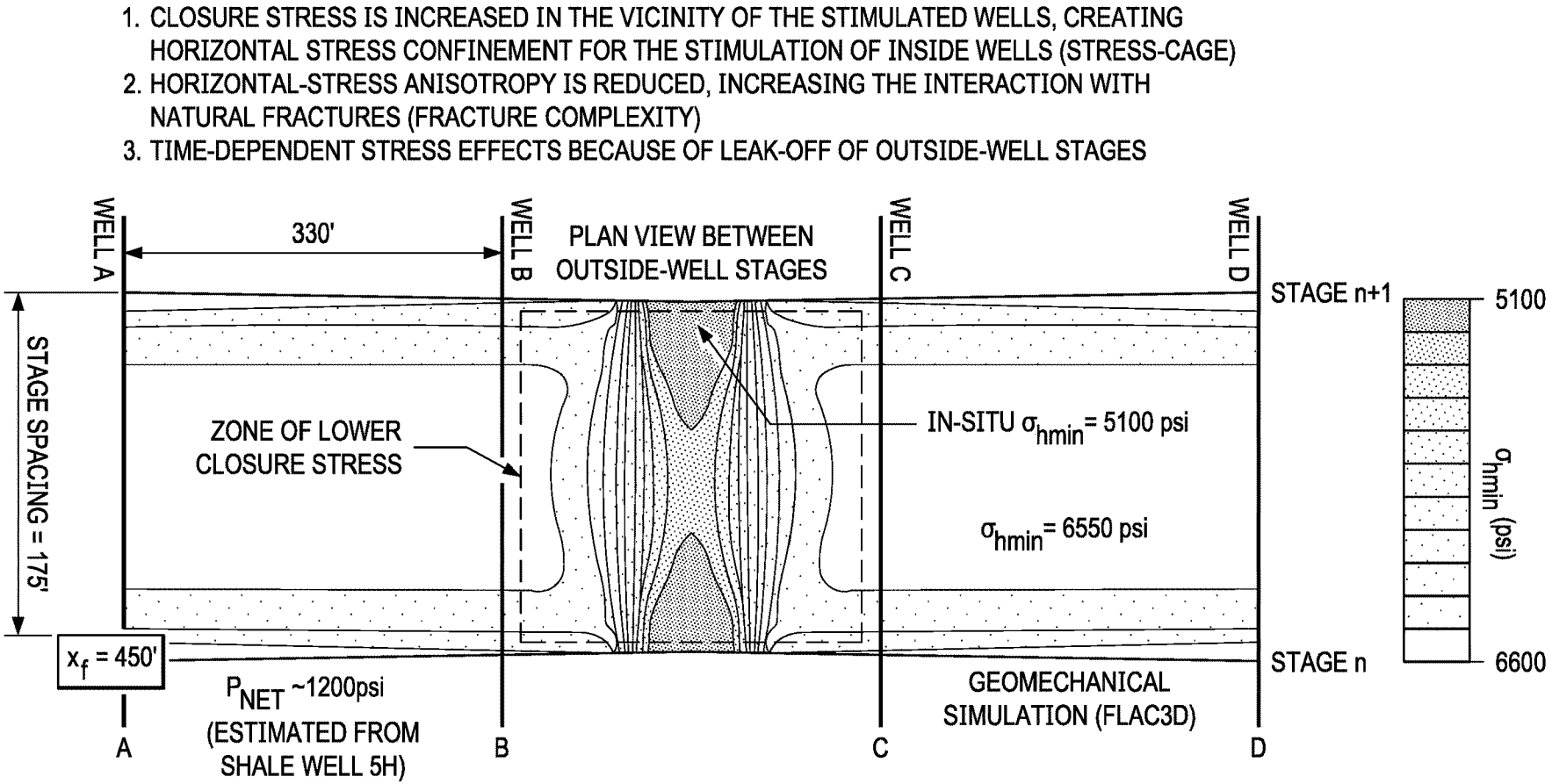
FIG. 7A-B: An example of stress cage generation.
Figure 7B:
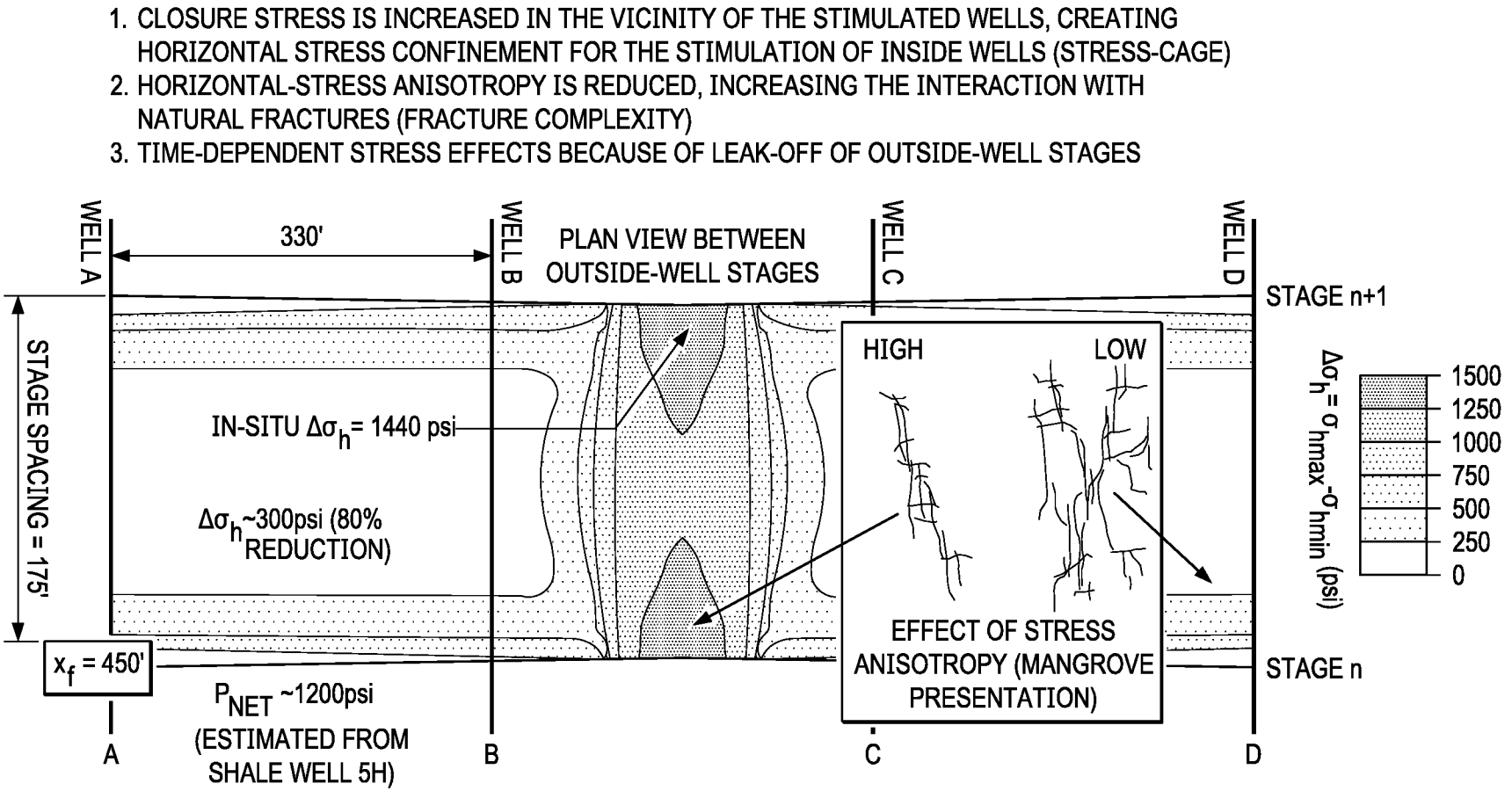

FIGS. 7A and 7B show a top view of four parallel horizontal wells, with closure stress ($\sigma_{hmin}$) shown in color in FIG. 7A, and $\Delta\sigma_h=\sigma_{hmax}-\sigma_{hmin}$ (psi) in FIG. 7B. These graphs are between two successive frack stages and show the results of a numerical calculation (using a geomechanical model) of the change in minimum horizontal stress ($\sigma_{hmin}$) and horizontal stress anisotropy ($\sigma_{hmax}-\sigma_{hmin}$) in the stress cage that is induced by the stimulation of the outside wells. As a result of the outside-well stimulation, the closure stress is increased, and the stress anisotropy is considerable reduced to a near-isotropic state.

Figure 8:
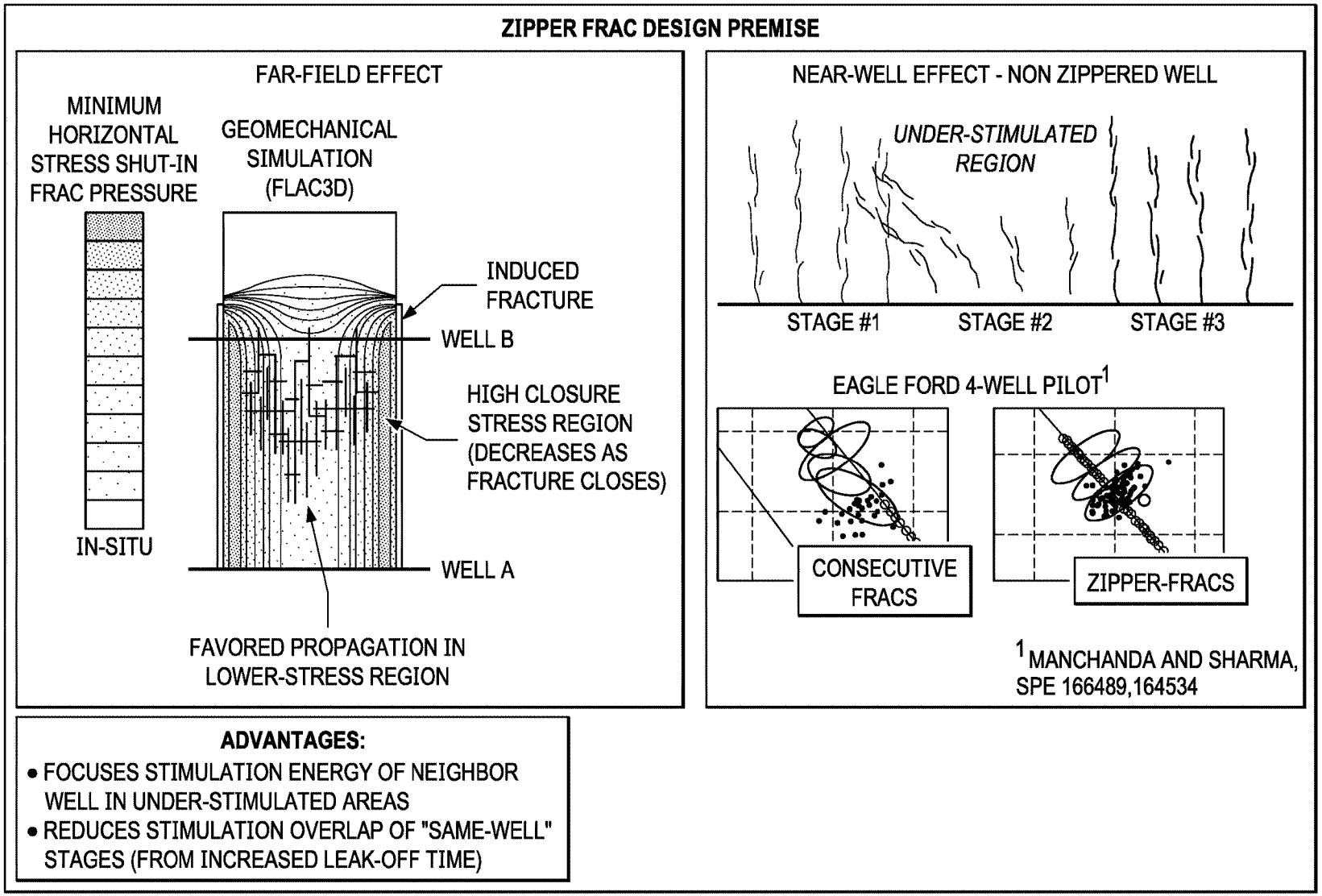
FIG. 8: Zipper frack design.

FIG. 8 shows a zipper fracture design according to the invention. A zipper frack, sometimes known as "simulfrack" calls for fracturing operations to be carried out concurrently at two parallel horizontal wellbores where the wellbores are not very far from each other. However, there are several variations on this idea, see e.g., FIG. 14A-E. In our design, we employed alternating fracks that can be staggered or not, and the outermost wells are fracked before the inner wells.

The overall pattern can be varied as needed based on the operators' goals, but one preferred embodiment is to stagger and alternate the outside wells, then stagger and alternate the inside wells. If desired, a two-step pattern can also be employed, provided that the outer wells are fracked first, then the inner wells. As yet another possibility, the fracture zones need not be staggered, or some can be staggered and others not. The goal, however, is to control the complexity of the fracture network and its placement by controlling the anisotropy by creating stress cages.

FIG. 8 illustrates the two main advantages of zipper-fracturing versus completing each well one at a time. The first advantage works at the far-field scale where fracture induced from one of the zipper-fracked well will tend to avoid the zones already stimulated by the other well in the zipper-frack sequence because of higher stresses. Such phenomenon is likely to occur whether the stages of the zipper-fracked wells are staggered or not, because of stress interference phenomena. The second advantage occurs at the near-wellbore scale. Alternating fracturing between multiple wells increases the lag time between successive stages for each given well. This extra time allows unpropped fractures to close more effectively, hence reducing stimulation overlap between successive stages in each well.

A pilot program was developed and performed to test the principles described herein. The pilot had three main objectives:

1. Show that designing different frack sequence could alter the stress regime, and create a near-isotropic condition for the inside wells. This was demonstrated using ISIP analysis.

2. Show that the near-isotropic stress state lead to additional fracture complexity. Distributed Temperature Sensing (DTS) in the middle wells of the pilot program (Shale I wells 10H and 11H) demonstrated increased fracture density during the stimulation of the inner wells (<3'/frac) compared to when the outer wells were stimulated (~35'/frack, comparable to cluster spacing).

3. Show that additional fracture complexity impacted production positively.

Figure 9:
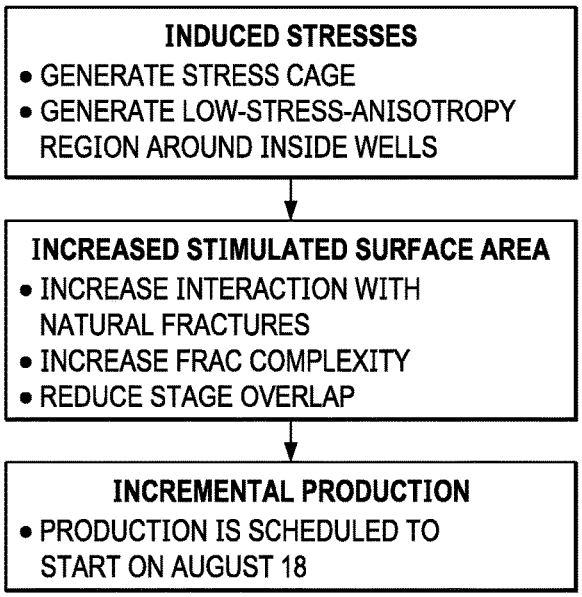
FIG. 9: Pilot objectives.

As illustrated in FIG. 9, the pilot well involved inducing stress to generate a stress case and low horizontal-stress anisotropy regions around the inside well, increasing the stimulated surface area and then incrementally improving production. The pilot was performed on the following wells from the Shale I reservoir: 6HG, 7H, 10H, and 11H.

Figure 10:
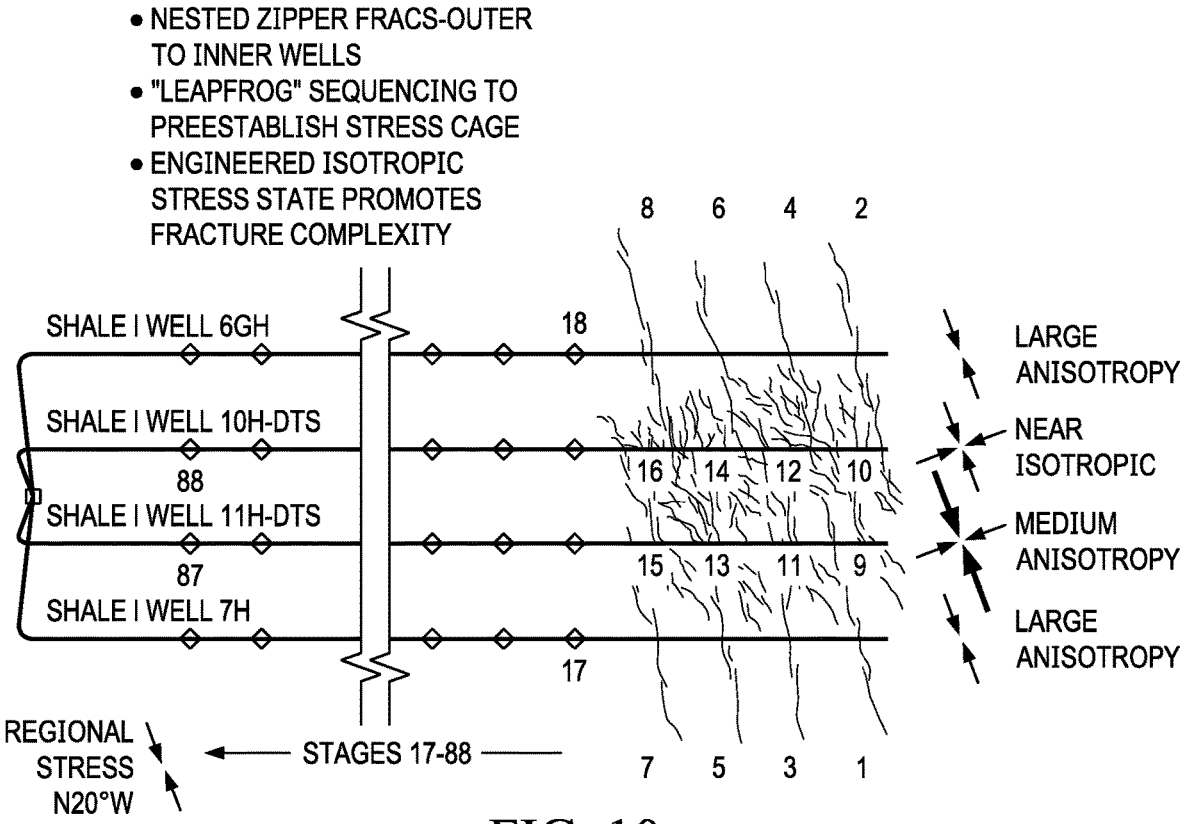
FIG. 10: Shale I formation pilot fracturing sequence.

As described above, the pilot program used a nested or staggered zipper frack pattern, with leapfrog sequencing, to establish the stress cages to promote fracture complexity in those zones with isotropic stress. FIG. 10 displays this frack sequence. It was designed to create a near-isotropic stress condition for the inside wells and for the inside wells to take advantage of that altered-stress condition and induce fracture complexity.

The sequence is the following: the outside wells (7H and 6HG) are zipper-fracked alternatingly for the first 8 stages (4 on each well). The number of stages was chosen to maximize the amount of stress induced by the outside wells. The inner wells (10H and 11H) are then zipper-fracked for the following 8 stages. We call this fracture sequence "nested zipper fracks." The sequence of 16 stages was then repeated until 88 total stages were completed (22/well).

The inputs for the initial design in FIG. 10 were determined using ISIP analysis on three other wells in the same reservoir: 8H, 9H and 1H. These wells are in a similar area to the Shale pilot. Analyzing very tight completions in a similar area allowed the user to quantify the in-situ horizontal stress anisotropy in the area. Two input parameters were determined by looking at these three wells: (1) the in-situ horizontal stress anisotropy in the area and (2) the amount of stress induced by a multi-stage completion ($\Delta\sigma_{plateau}$) for different values of the perf. cluster spacing.

Figure 11:
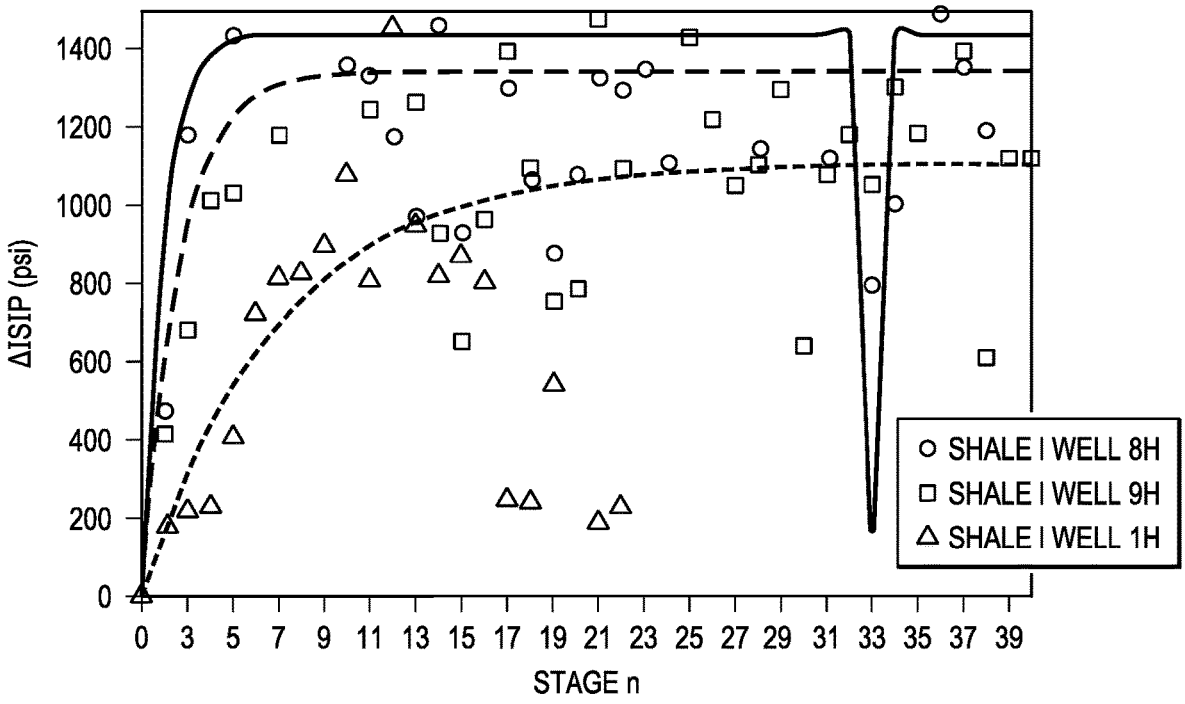
FIG. 11: In-situ horizontal-stress anisotropy determination in Shale I formation.

ISIPs can be measured downhole or at the wellhead. For the pilot program, ISIP was measured at the surface for all wells. FIG. 11 shows the ISIP escalation for these three wells located in the shale formation and Table 1 summarizes the results of ISIP analysis on the three wells. The goal with the ISIP analysis was to evaluate the in-situ horizontal stress anisotropy and obtain information that could be used to design the pilot stimulation.

TABLE 1

ISIP analysis results from Shale I formation wells

| Well | $s_f$ (ft) | $\Delta\sigma_{plateau}$ (psi) | Escalation | $s_f/2h_f$ | Interference Ratio | $\sigma_{load}$ (psi) | Calculated hydraulic height (ft) | Calculated stress anisotropy (psi) |
|---|---|---|---|---|---|---|---|---|
| Shale I Well 8H | 85 | 1440 | 0.92 | 1.72 | 0.56 | 2795 | >49 | ~1440 |
| Shale I Well 9H | 85 | 1344 | 1.63 | 1.13 | 0.72 | 1227 | >102 | ~1344 |
| Shale I Well 1H | 140 | 1108 | 6.0 | 0.49 | 0.91 | 264 | 292 | >1108 |

From these results, we can see that the stress anisotropy has been overcome for 8H and 9H wells, as the calculated stress load (Table 1) is higher than the net pressure at shut-in (FIG. 11). The lower values of interference ratio compared to 1H, even though stage spacing for these wells has been reduced by 50%, is another indication that stress anisotropy has been overcome.

In this condition, the value of the stress plateau ($\sigma_{Plateau}$) is approximately equal to the in-situ horizontal-stress anisotropy. Values of ($\sigma_{hmax}-\sigma_{hmin}$) for both wells are very close, with the average value being 1392 psi. This average value was used to design the Shale I formation pilot well.

The third well (1H), on the other hand, does not seem to overcome horizontal-stress anisotropy. This is illustrated by the calculated stress load being below the net pressure at shut-in. Such disparity in values is a strong indication that horizontal-stress anisotropy is higher than 1108 psi. This example demonstrates that analyzing ISIPs for multiple wells in a similar area can narrow down tremendously the range of horizontal-stress anisotropy. Further, due to the similarities in these wells and the wells used in the pilot, the values can be used to modify the initial well design.

From this initial ISIP analysis, we found the in-situ horizontal stress anisotropy ($\sigma_{hmax}-\sigma_{hmin}$), hydraulic fracture dimensions (height, length), the stress induced by one frack stage ($\sigma_{load}$), and the stress induced by a multi-stage horizontal-well completion ($\Delta\sigma_{plateau}$) for multiple perf. cluster spacing designs. All those inputs were used to design the specific multi-well fracture sequence, number of wells, and well spacing in the Shale I formation pilot to engineer the stress regime that will maximize fracture complexity. Thus, using the information and parameters obtained from the ISIP analysis of the Shale I wells, we designed the completion of the Shale I formation pilot well.

In the Shale I formation pilot, the fracture locations are not staggered, at least not by design. In practice, there is some staggering of the perforation clusters since the direction of maximum horizontal stress (following by the fractures) is not exactly perpendicular to the wells. This is why the fractures appear slanted in FIG. 10. As seen in FIG. 10, well 10H benefits from the fact that well 11H is stimulated first in the inner-well zipper-fracks, though both wells seem to benefit from near-isotropic stress conditions During the stimulation of the Shale I formation pilot, the ISIP data was recorded to allow us to evaluate the final state of stress and make any needed adjustments.

Figure 12A:
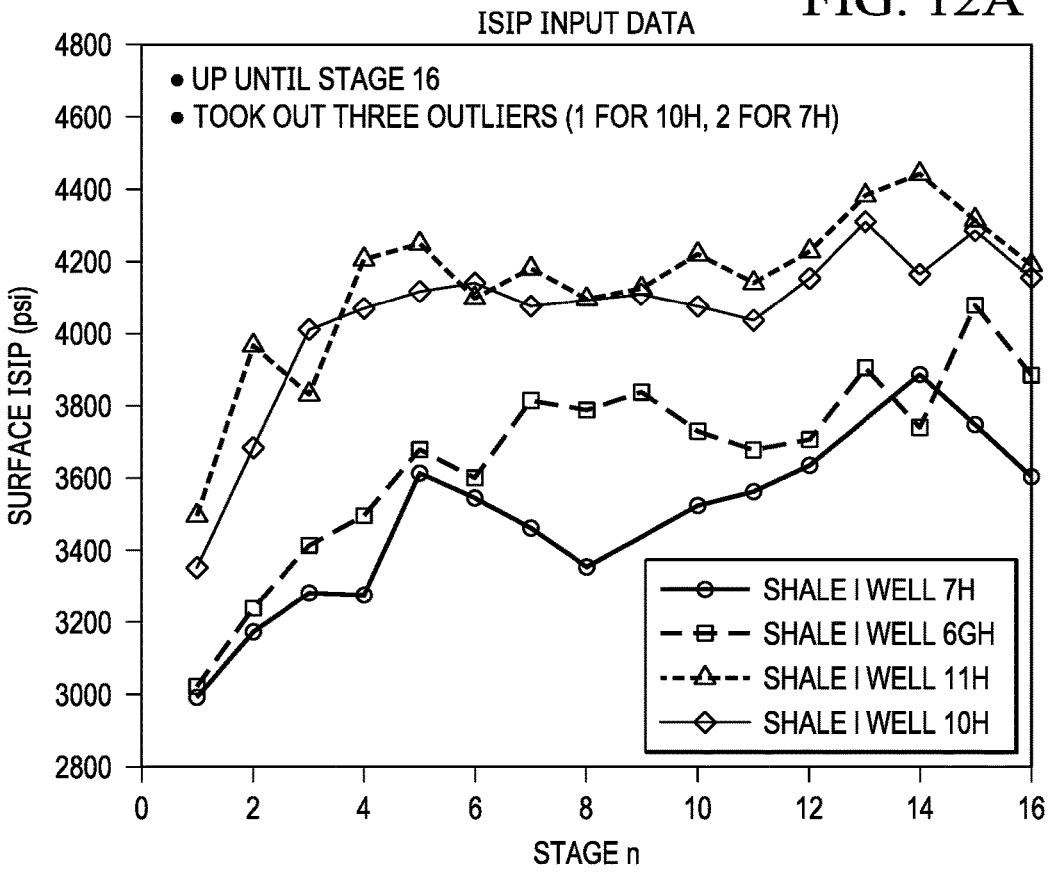
FIG. 12A-B: ISIP data (12A) and escalation analysis (12B) of Shale I formation pilot wells.
Figure 12B:
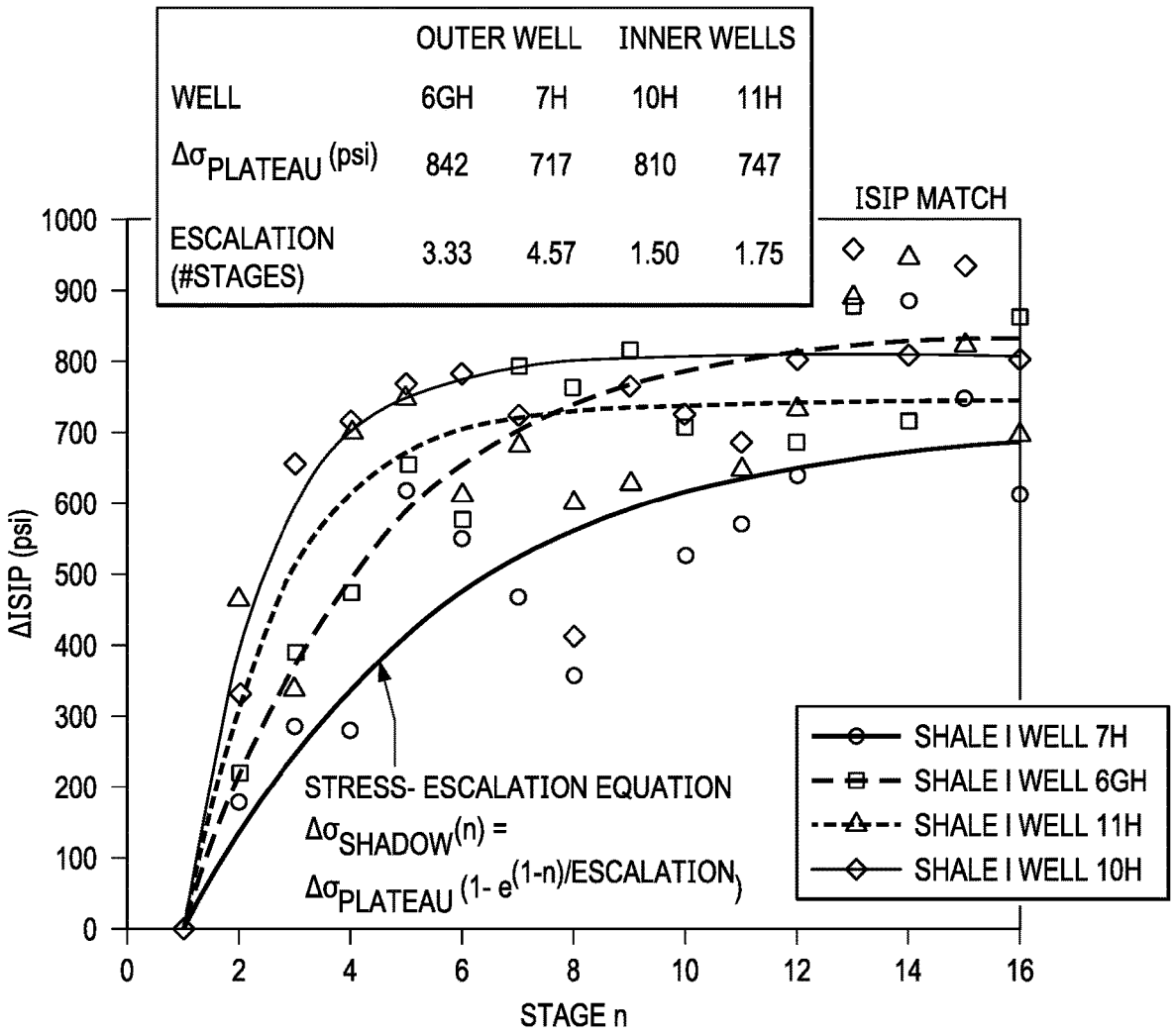

The ISIP is normally recorded at the end of each fracturing stage. FIG. 12A shows the ISIP data for the first 16 stages. The inside wells' ISIPs trend higher than the outer well ISIPs, since they take advantage of the stress induced by the outer wells. We used the ISIP Analysis to evaluate the amount of stress that was induced by each well. FIG. 12B shows the results of matching the ISIP escalation with a stress-escalation equation using the ISIP Analysis described in Ser. No. 62/427,262.

Figure 13:
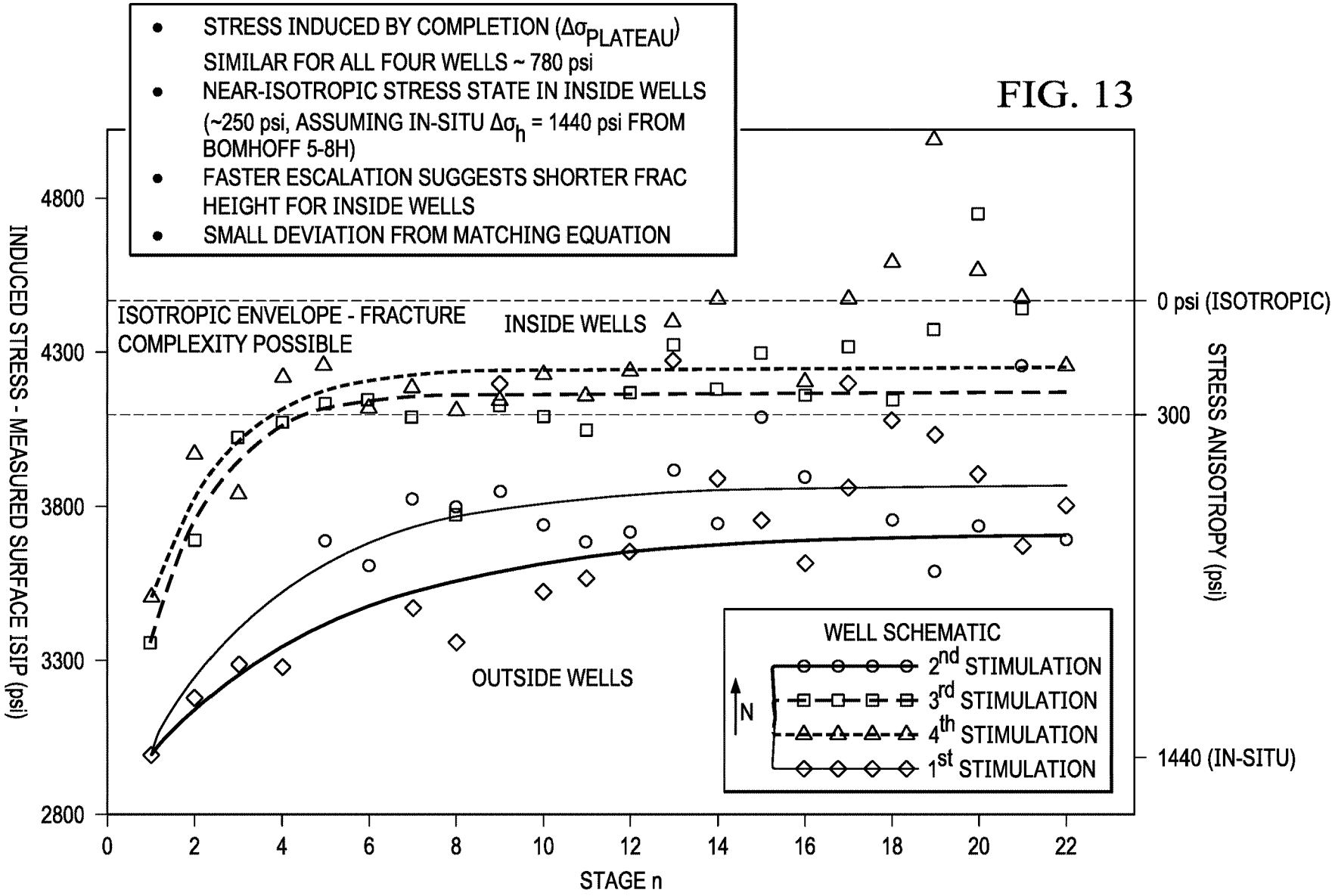
FIG. 13: Confirmation of engineered state of stress in the Shale I formation pilot well.
Figure 14A:
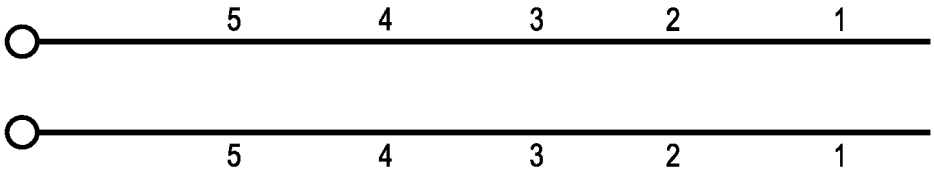
FIG. 14A-E: Various zipper frack patterns on multiple (14A-D) or single wells (14E).
Figure 14B:
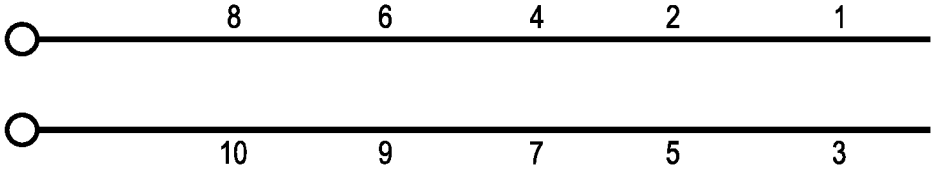
Figure 14C:
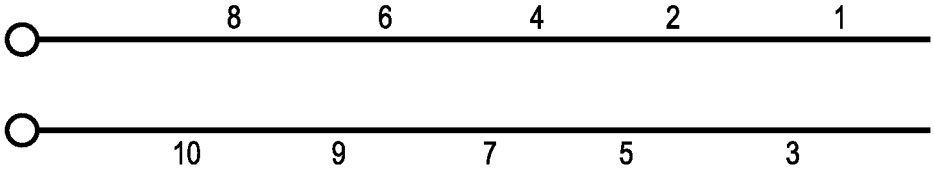
Figure 14D:
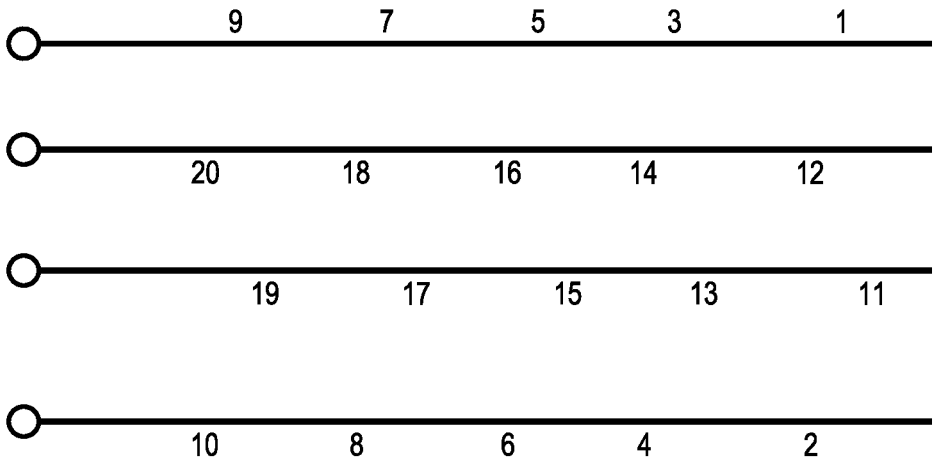
Figure 14E:
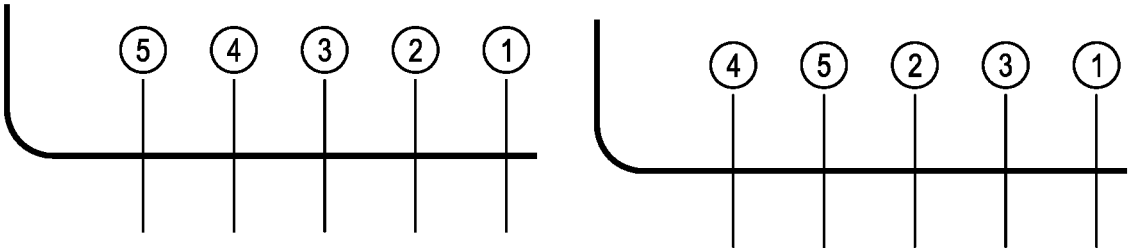

The plot in FIG. 13 confirms that the stress induced by the fracturing sequence across the four pilot wells escalated the minimum horizontal stress by a magnitude close to the in-situ horizontal stress anisotropy, thus creating a near-isotropic stress regime. As mentioned above, the inside wells' ISIPs trend higher than the outer well ISIPs, since they take advantage of the stress induced by the outer wells. As a result, the inner well reach a near-isotropic state (stress envelope) after a couple frack stages. It demonstrated the possibility for the inner wells to generate fracture complexity. As more stress is being induced by the completion, horizontal stress anisotropy declines from its in-situ value (~1440 psi) to the target of near-isotropy ($\sigma_{hmax}-\sigma_{hmin}$<300 psi).

This information allows the user to evaluate the amount of stress induced by each well. In the Shale I formation pilot, the data confirms the initial stimulation design was appropriate. By using the proposed multi-well sequencing workflow, we were able to increase fracture complexity to improve hydrocarbon recovery without the expense or time needed to increasing the number of perforation clusters.

The following references are incorporated by reference in their entirety for all purposes.

ARMA-82-183: Gronseth M., Determination Of The Instantaneous Shut In Pressure From Hydraulic Fracturing Data And Its Reliability As A Measure Of The Minimum Principal Stress (1982).

SPE-11064-MS: McLennan J. D & Roegiers J. C., How Instantaneous are Instantaneous Shut-In Pressures? (1982).

SPE 133380: Soliman, M. Y. et al., Methods for Enhancing Far-Field Complexity in Fracturing Operations (2010).

SPE-127986-PA: Roussel N. P., et al., Optimizing Fracture Spacing and Sequencing in Horizontal-Well Fracturing (2011).

SPE 101593: Song J. H. et al., Preventing Mud Losses by Wellbore Strengthening (2006)

SPE 159786: M. Rafiee M., et al., Hydraulic Fracturing Design and Optimization: A Modification to Zipper Frack (2012).

U.S. Pat. No. 8,210,257 Fracturing a stress-altered subterranean formation

US20140048270 Methods and devices for hydraulic fracturing design and optimization: a modification to zipper frac US20120152550 U.S. Pat. No. 8,733,444 Method for Inducing Fracture Complexity in Hydraulically Fractured Horizontal Well Completions COP 42328US01 U.S. Application Ser. No. 62/427,262, filed Nov. 29, 2016.

The invention claimed is:

1. A method of hydrocarbon recovery using hydraulic fracturing in a reservoir, comprising:

a) inputting one or more fracture parameters into a reservoir model stored in a non-transitory memory of a computer;

b) inputting one or more well parameters into said reservoir model;

c) inputting one or more reservoir rock parameters into said reservoir model;

d) inputting a fracture sequence into said reservoir model, wherein said fracture sequence utilizes multiple wells and multiple fracturing stages, wherein said multiple wells include outer and inner wells, wherein said fracture sequence further comprises zipper fracturing a section or totality of said outer wells before zipper fracturing a section or totality of said inner wells;

e) simulating said reservoir model to predict a fracturing outcome;

f) interpreting said fracture outcome to determine horizontal stress anisotropy, stress cage generation, and/or fracture complexity for one or more fractured zones;

g) iteratively updating said fracture parameters and well parameters and re-simulating said reservoir model to increase the stress cage generation in one or more fracture zones in said fracture outcome; and;

h) implementing said re-simulated reservoir model in said reservoir.

2. The method of claim 1) further comprising step i) producing hydrocarbons.

3. The method of claim 1) wherein said updating step g comprises minimizing the horizontal stress anisotropy and increasing fracture complexity in the same fracture zone.

4. The method of claim 1) wherein said updating step g comprises further minimizing the horizontal stress anisotropy, increasing the stress cage generation and increasing fracture complexity in the same fracture zone.

5. The method of claim 1), wherein said zipper fracturing is nested zipper fracturing, alternating zipper fracturing, staggered zipper fracturing, or any combination thereof.

6. The method of claim 1), wherein said zipper fracturing is alternating or staggered zipper fracturing or both.

7. The method of claim 1), wherein said reservoir rock parameters comprise one or more of the following: magnitude and direction of in-situ principal stresses, overburden stress, minimum closure stress, maximum horizontal stress, rock density, rock porosity, rock permeability, rock mineral content, rock laminations, density and length of natural fractures, mechanical properties, Young's modulus and Poisson ratio.

8. The method of claim 7), wherein said fracture parameters were calculated using an instantaneous shut-in pressure (ISIP) analysis in a similar well in said reservoir.

9. The method of claim 8), wherein the ISIP analysis is performed for a variety of fluid types, slurry volumes, proppant types, proppant mass, proppant concentrations, and/or injection rates.

10. The method of claim 1), wherein said fracture parameters comprise one or more of the following: number of fracture stages, number of perforation clusters per stage, an order of fracturing for each stage, a fracture treatment rate or pressure for each stage, a fracturing fluid for each stage, a proppant type for each stage, a proppant density for each stage, a perforation cluster spacing and/or a perforation density for each stage, calculated horizontal stress anisotropy for each stage, calculated stress plateau, fracture density, and/or fracture height.

11. The method of claim 1), wherein said well parameters comprise one or more of the following: well number, well length and diameter, well spacing, well orientation, reservoir pressure, and fluid PVT properties.

12. A method of hydrocarbon recovery using hydraulic fracturing in a reservoir, comprising:

a) inputting one or more fracture parameters into a reservoir model stored in a non-transitory memory of a computer;

b) inputting one or more well parameters into said reservoir model;

c) inputting one or more reservoir rock parameters into said reservoir model;

d) inputting a fracture sequence into said reservoir model, wherein said fracture sequence utilizes multiple wells and multiple fracturing stages, wherein said multiple wells include outer and inner wells, wherein said fracture sequence further comprises zipper fracturing said outer wells before zipper fracturing said inner wells;

e) simulating said reservoir model to predict a fracturing outcome, wherein said reservoir model is a multistage fracturing plan;

f) implementing said multistage fracturing plan of said simulated reservoir model in said reservoir;

g) evaluating each stage of said multistage fracturing plan using distributed temperature sensing (DTS), production data, production interference test, downhole gauges, microseismicity, and instantaneous shut-in pressure;

h) iteratively updating said fracture parameters and well parameters and re-simulating said reservoir model after each stage to increase the stress cage generation in one or more fracture zones in said fracture outcome; and;

i) implementing said re-simulated reservoir model in said reservoir.

13. The method of claim 12), further comprising step j) producing hydrocarbons.

14. The method of claim 12), wherein said updating step h comprises further minimizing the horizontal stress anisotropy and increasing fracture complexity in the same fracture zone.

15. The method of claim 12), wherein said updating step step h comprises further minimizing the horizontal stress anisotropy, increasing the stress cage generation and increasing fracture complexity in the same fracture zone.

16. The method of claim 12), wherein said evaluating step comprises calculating fracture parameters using an Instantaneous Shut-In Pressure (ISIP) analysis.

* * * * *